US006043194A

United States Patent [19]

Saito et al.

[11] Patent Number: 6,043,194

[45] Date of Patent: Mar. 28, 2000

[54] PROTECTIVE LAYER TRANSFER SHEET

[75] Inventors: Hitoshi Saito; Shino Takao; Yuji Matufuji, all of Shinjuku-Ku, Japan

[73] Assignee: Dai Nippon Printing Co., Ltd., Japan

[21] Appl. No.: 09/195,443

[22] Filed: Nov. 18, 1998

[30] Foreign Application Priority Data

Nov. 20, 1997 [JP] Japan ..... 9-336462

[51] Int. Cl.[7] ..... B41M 5/035; B41M 5/38

[52] U.S. Cl. ..... 503/227; 428/195; 428/412; 428/913; 428/914

[58] Field of Search ..... 8/471; 428/195, 428/412, 913, 914; 503/227

[56] References Cited

U.S. PATENT DOCUMENTS 4,927,803 5/1990 Bailey et al. ..... 503/227

*Primary Examiner*—Bruce H. Hess

*Attorney, Agent, or Firm*—Parkhurst & Wendel, L.L.P.

[57] ABSTRACT

There is provided a protective layer transfer sheet comprising: a substrate sheet; and a thermally transferable protective layer provided on at least a part of one side of the substrate sheet, the protective layer comprising at least an aromatic polycarbonate resin which is soluble in a nonhalogenated solvent and has a glass transition temperature Tg of 80° C. or above.

There is also provided a print comprising a substrate having, on at least one side thereof, at least a dye image and a protective layer covering at least a part of the image, the protective layer having been formed by transfer from the above protective layer transfer sheet.

9 Claims, 2 Drawing Sheets

PROTECTIVE LAYER TRANSFER SHEET

BACKGROUND OF THE INVENTION

1. Field of the Invention

The present invention relates to a protective layer transfer sheet. More particularly, the present invention relates to a protective layer transfer sheet which can provide a print, comprising a substrate having thereon an image, possessing excellent fastness properties.

2. Background Art

Halftone images and monotone images, such as letters and symbols, have hitherto been formed on a substrate by thermal transfer. Thermal transfer methods widely used in the art are thermal dye transfer and thermal ink transfer.

The thermal dye transfer is a method which comprises the steps of: providing a thermal transfer sheet comprising a substrate sheet bearing a dye layer formed of a sublimable dye as a colorant melted or dispersed in a binder resin; putting this thermal transfer sheet on the top of a substrate (optionally having a dye-receptive layer); applying energy corresponding to image information to a heating device, such as a thermal head, to transfer the sublimable dye contained in the dye layer onto the substrate, thereby forming an image.

For the thermal dye transfer, the amount of the dye to be transferred can be regulated dot by dot by regulating the quantity of energy applied to the thermal transfer sheet. Therefore, excellent halftone images can be obtained. In this method, however, unlike the formation of an image by a conventional printing ink using a pigment as the colorant, a relatively low-molecular weight dye is used as the colorant, and, in addition, a vehicle is absent. For this reason, the formed image is disadvantageously poor in fastness properties, such as light fastness, weather fastness, and rubbing fastness.

One method for solving the above problem of the prior art is to transfer a protective layer comprising an ultraviolet absorber or the like onto the formed image.

Some fastness properties of the image can be improved by this method. In the case of the conventional protective layer transfer sheet, however, the light fastness of the image is unsatisfactory. Cyan dyes are particularly likely to fade. Therefore, light irradiation leads to a lowering in density of the image and, at the same time, causes a change in hue to red, resulting in remarkably deteriorated image quality.

Another method for solving the above problem is to use an aromatic polycarbonate resin, capable of providing a print having an image, particularly a cyan dye image, possessing excellent light fastness, in a dye-receptive layer provided on a substrate (see, for example, in Japanese Patent Laid-Open Nos. 169694/1987 and 131758/1993). Further, improving the transferability of a dye onto a dye-receptive layer comprising an aromatic polycarbonate resin has also been disclosed (see, for example, in Japanese Patent Laid-Open Nos. 301487/1990 and 80291/1990).

Use of the aromatic polycarbonate resin as the protective layer in the protective layer transfer sheet is considered effective for solving the above problem. In this case, however, polycarbonate resins, derived from 2,2-bis(4-hydroxyphenyl)propane [bisphenol A] and represented by the following general formula, which have been described as preferred aromatic polycarbonate resins in most of the above publications, and copolymer polycarbonate resins disclosed in Japanese Patent Laid-Open No. 301487/1990 have low solubility in solvents, and chlorinated solvents, such as methylene chloride and trichloromethane, should be used in the production of the protective layer transfer sheet, posing a problem of work environment.

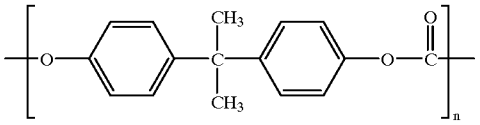

wherein n is an integer.

Another problem involved in the conventional protective layer transfer sheet is that kick back is likely to be created. The kick back refers to such a phenomenon that, in the course of production of an integral transfer sheet, comprising protective layers and dye layers provided in a face serial manner on a common transfer sheet, involving a plurality of times of winding and rewinding, for example, the steps of rewinding the protective layer and the dye layer after coating, such as winding after the completion of coating, winding at the time of slittering after the coating, and winding around a bobbin as a form of a product, during storage in a wound state until next steps, the dye is first transferred (kicked) from the dye layer onto the backside of the substrate sheet, and, at the time of rewinding in the next step, the kicked dye is retransferred (backed) onto the front side of the substrate sheet facing the kicked dye. Rolls prepared in respective steps are different from one another in opposed faces. This creates a problem wherein each color dye is transferred onto the surface of the protective layer by the kick back phenomenon.

The creation of the kick back phenomenon in the transparent protective layer leads to a problem that transfer of the protective layer onto an image causes the image to be colored with the dye transferred by the kick back phenomenon, resulting in remarkably deteriorated image quality.

The present invention has been made under the above circumstances, and an object of the present invention is to provide a protective layer transfer sheet which can provide a print having enhanced light fastness properties.

SUMMARY OF THE INVENTION

According to the present invention, the above object can be attained by a protective layer transfer sheet comprising: a substrate sheet; and a thermally transferable protective layer provided on at least a part of one side of the substrate sheet, the protective layer comprising at least an aromatic polycarbonate resin which is soluble in a nonhalogenated solvent and has a glass transition temperature Tg of 80° C. or above.

According to a preferred embodiment of the present invention, the aromatic polycarbonate resin comprises either a random copolymer of structural units represented by the following general formula (1) with not more than 70% by mole of structural units represented by the following general formula (2), or a homopolymer consisting of structural units represented by the following general formula (1):

(1)

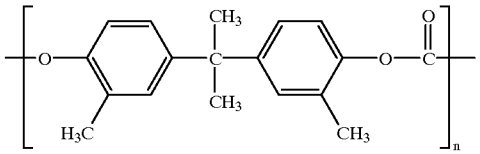

wherein n is an integer; and (2)

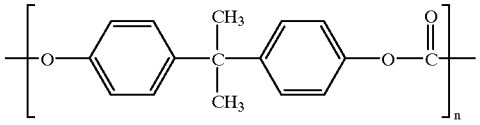

wherein n is an integer.

According to a preferred embodiment of the present invention, the protective layer comprises at least one member selected from the group consisting of an acrylic resin, a styrene resin, a polyester resin, and a polyvinyl acetal resin, each of the resins having a glass transition temperature Tg of 80° C. or above.

According to a preferred embodiment of the present invention, the protective layer comprises a random copolymer of a reactive ultraviolet absorber with an acrylic monomer, the random copolymer having a glass transition temperature Tg of 60° C. or above and represented by the following general formula (3):

(3)

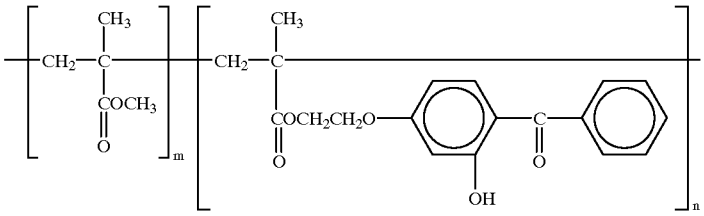

wherein m and n are an integer.

According to a preferred embodiment of the present invention, the protective layer comprises a benzotriazole ultraviolet absorber.

The print of the present invention comprises a substrate having, on at least one side thereof, at least a dye image and a protective layer covering at least a part of the image, the protective layer having been formed by transfer from any one of the above protective layer transfer sheets.

According to the protective layer transfer sheet of the present invention, the thermally transferable protective layer may be formed without use of any chlorinated solvent, permitting work environment to be protected. In addition, the thermally transferable protective layer has high ultraviolet absorption and excellent fastness, is much less likely to cause kick back, and can be surely transferred onto a dye image provided on a substrate. The protective layer transferred onto the image can effectively prevent the dye constituting the image to be faded by light, and can provide a print having an image possessing excellent fastness properties.

DETAILED DESCRIPTION OF THE PRESENT INVENTION

Embodiments of the present invention will be described in more detail with reference to the accompanying drawings.

Protective Layer Transfer Sheet

FIGS. 1 to 4 are schematic cross-sectional views showing embodiments of the protective layer transfer sheet according to the present invention.

Figure 1:
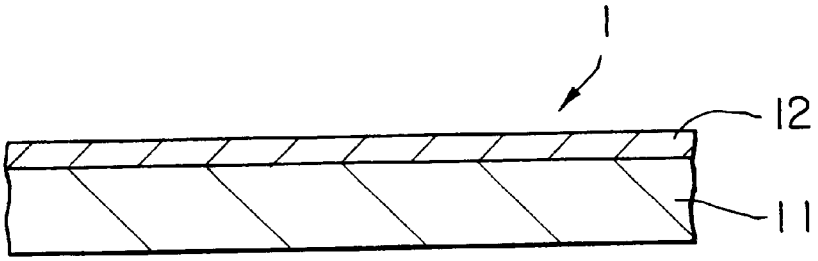
FIG. 1 is a schematic cross-sectional view showing a protective layer transfer sheet according to one embodiment of the present invention.

A protective layer transfer sheet 1, according to the present invention, shown in FIG. 1 is an embodiment having the simplest layer construction. In this layer construction, a thermally transferable protective layer 12 is provided on one side of a substrate sheet 11.

Figure 2:
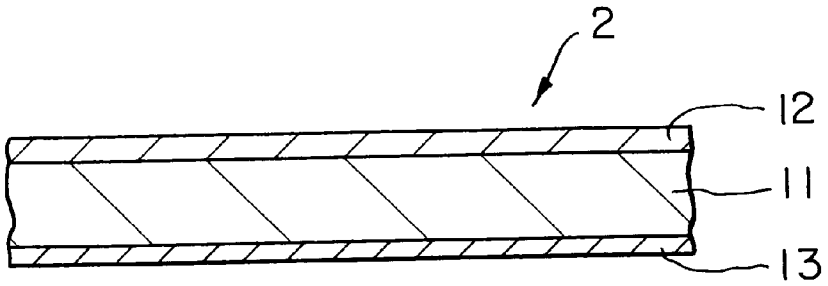
FIG. 2 is a schematic cross-sectional view showing a protective layer transfer sheet according to another embodiment of the present invention.

A protective layer transfer sheet 2, according to the present invention, shown in FIG. 2 has the same layer construction as the protective layer transfer sheet 1 shown in FIG. 1, except that a backside layer 13 is provided on the substrate sheet 11 in its side remote from the thermally transferable protective layer 12.

Figure 3:
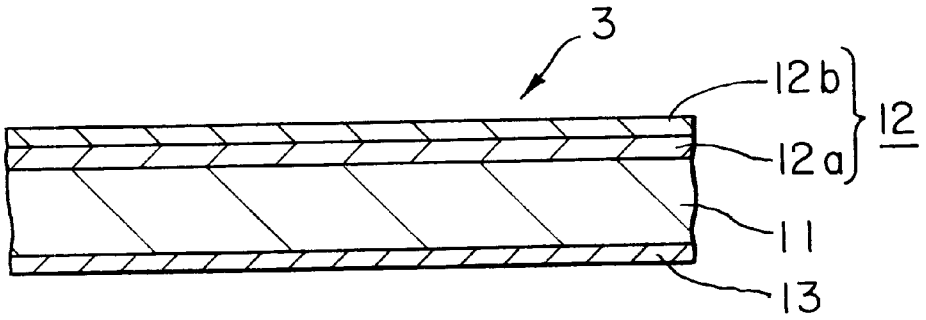
FIG. 3 is a schematic cross-sectional view showing a protective layer transfer sheet according to still another embodiment of the present invention.

A protective layer transfer sheet 3, according to the present invention, shown in FIG. 3 has a laminate structure comprising: a substrate sheet 11; a thermally transferable protective layer 12 provided on one side of the substrate sheet 11; and a backside layer 13 provided on the other side of the substrate sheet 11, the thermally transferable protective layer 12 comprising a protective layer 12*a* and an adhesive layer 12*b*.

Figure 4:
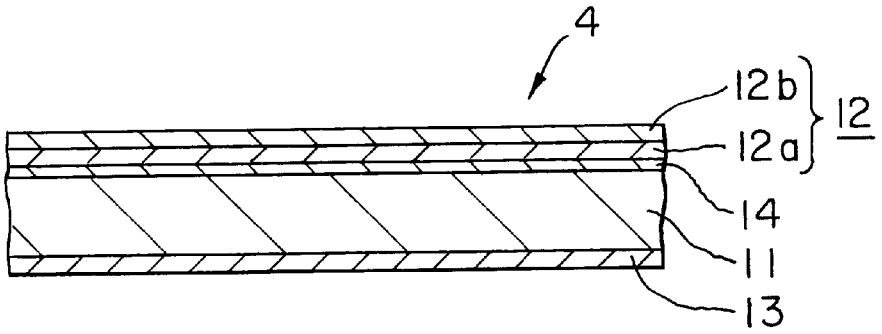
FIG. 4 is a schematic cross-sectional view showing a protective layer transfer sheet according to a further embodiment of the present invention.

A protective layer transfer sheet 4, according to the present invention, shown in FIG. 4 has the same layer construction as the protective layer transfer sheet 3 shown in FIG. 3, except that a release layer 14 is provided between the substrate sheet 11 and the protective layer 12. Also in the protective layer transfer sheets 1 and 2, the release layer 14 may be provided between the protective layer 12 having a single-layer structure and the substrate sheet 11. The release layer 14 is constructed so that, when the protective layer 12 is thermally transferred, the release layer 14 per se is left on the substrate sheet 11 side.

Next, layers constituting the protective layer transfer sheet of the present invention will be described.

(1) Substrate sheet

In the protective layer transfer sheet of the present invention, the substrate sheet 11 may be any substrate sheet used in conventional thermal transfer sheets. Specific examples of preferred substrate sheets include tissue papers, such as glassine paper, capacitor paper, and paraffin paper; stretched or unstretched films of plastics, for example, polyesters, such as polyethylene terephthalate, polyethylene naphthalate, and polybutylene terephthalate, polyphenylene sulfite, polyether ketone, polyethersulfone, polypropylene, polycarbonate, cellulose acetate, derivatives of polyethylene, polyvinyl chloride, polyvinylidene chloride, polystyrene, polyamide, polyimide, polymethylpentene, and ionomers; materials prepared by subjecting the above materials to treatment for improving the adhesion; and laminates of the above materials. The thickness of the substrate sheet 11 is suitably determined depending upon materials for the substrate sheet so that the substrate sheet has proper strength, heat resistance and other properties. In general, however, the thickness is preferably about 1 to 100 $\mu$m.

(2) Thermally transferable protective layer (protective layer)

The thermally transferable protective layer 12 in the protective layer transfer sheets 1 and 2 of the present invention and the protective layer 12*a* in the protective layer transfer sheets 3 and 4 of the present invention comprise at least an aromatic polycarbonate resin that is soluble in a nonhalogenated solvent and has a glass transition temperature Tg of 80° C. or above.

The expression "aromatic polycarbonate resin which is soluble in a nonhalogenated solvent" used herein refers to an aromatic polycarbonate resin which, when added in an amount of 20% by weight to a solvent of a 1:1 mixture of methyl ethyl ketone and toluene followed by shaking at room temperature for 8 hr, is dissolved in the solvent to prepare a transparent solution. Use of the aromatic polycarbonate resin soluble in the nonhalogenated solvent permits the thermally transferable protective layer 12 (protective layer 12*a*) to be formed without use of any chlorinated solvent which is unfavorable from the viewpoint of work environment.

When the aromatic polycarbonate resin has a glass transition temperature Tg of 80° C. or above, the development of the kick back phenomenon in the protective layer transfer sheet can be prevented. As described above, the term "kick back" used herein refers to such a phenomenon that, in the course of production of an integral transfer sheet involving a plurality of times of winding, for example, winding after the completion of coating and winding at the time of slittering, the dye is first transferred (kicked) from the dye layer onto the backside of the substrate sheet, and, at the time of winding in the next step, the kicked dye is retransferred (backed) onto the protective layer.

Aromatic polycarbonate resins usable herein include, for example, homopolymer polycarbonate resins derived from 2,2-bis(4-hydroxy-3-methylphenyl)propane [bisphenol C] and represented by the general formula (1):

(1)

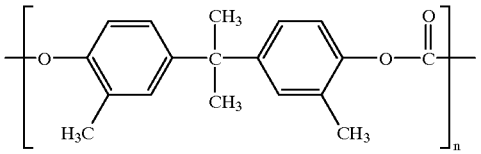

wherein n is an integer;

homopolymer polycarbonate resins derived from 1,1-bis(4-hydroxyphenyl)cyclohexane [bisphenol Z] and represented from the following general formula (4):

(4)

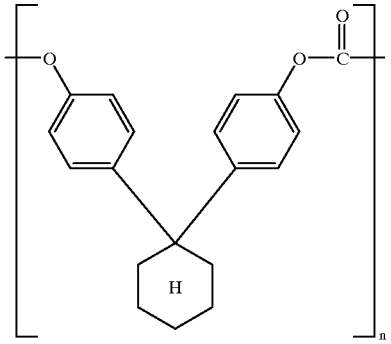

wherein n is an integer; and random copolymer polycarbonate resins comprising structural units represented by the general formula (1) and structural units derived from 2,2-bis(4-hydroxyphenyl)propane [bisphenol A] and structural units represented by the following general formula (2) (the content of structural units represented by the general formula (2): not more than 70% by mole):

(2)

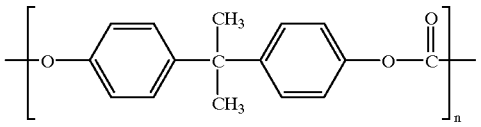

wherein n is an integer.

The viscosity average molecular weight of these haromatic polycarbonate resins is 5,000 to 100,000, more preferably 10,000 to 50,000. When the viscosity average molecular weight is less than 5,000, the coating has poor mechanical strength and hence is unsatisfactory as a protective layer. On the other hand, a viscosity average molecular weight exceeding 100,000 poses a problem that solubility in general-purpose solvents and, when use of the aromatic polycarbonate resin as a blend with other resins is contemplated, compatibility with the other resins is deteriorated.

In particular, the above aromatic polycarbonate resin can impart light fastness to a print having a cyan dye image, and, as described below, when a protective layer formed of the aromatic polycarbonate resin is transferred onto an image in a print, fading of the dye constituting the image by light can be effectively prevented. That is, the aromatic polycarbonate resin can provide a print having excellent fastness properties through the solution of the problem of the conventional protective layer transfer sheet that dyes, particularly cyan dyes, have unsatisfactory light fastness and are likely to fade and, hence, irradiation of the dye image with light leads to a lowering in density of the image and, at the same time, causes a change in hue to red, resulting in remarkably deteriorated image quality.

Among the aromatic polycarbonate resins, homopolymer polycarbonate resins derived from bisphenol C and represented by the general formula (1) and random copolymer polycarbonate resins comprising structural units derived from bisphenol C and structural units derived from bisphenol A are preferred from the viewpoint of material cost. Further, in the case of the random copolymer polycarbonate resins, those having a glass transition temperature Tg of 120° C. or above are particularly preferred from the viewpoint of fastness to kick back.

According to the protective layer transfer sheet of the present invention, the thermally transferable protective layer 12 and the protective layer 12*a* may comprise, in addition to the above aromatic polycarbonate resin, 25 to 75% by weight of at least one resin selected from acrylic resins, styrene resins, polyester resins, and polyvinyl acetal resins, these resins having a glass transition temperature Tg of 80° C. or above. The incorporation of these resins contributes to a further improvement in fastness properties, such as rubbing fastness and scratch fastness, of the thermally transferable protective layer 12 and the protective layer 12*a* .

In order to improve the ultraviolet absorption, the thermally transferable protective layer 12 and the protective layer 12*a* in the protective layer transfer sheet of the present invention may comprise 5 to 50% by weight of a random copolymer having a glass transition temperature Tg of 60° C. or above, preferably 80° C. or above, the random copolymer having been prepared by random-copolymerizing a reactive ultraviolet absorber with an acrylic monomer.

The reactive ultraviolet absorber may be one prepared by introducing, for example, an addition-polymerizable double bond of a vinyl, acryloyl, or methacryloyl group or an alcoholic hydroxyl, amino, carboxyl, epoxy, or isocyanate group into a nonreactive ultraviolet absorber, for example, a conventional organic ultraviolet absorber, such as a salicylate, benzophenone, benzotriazole, substituted acrylonitrile, nickel chelate, or hindered amine nonreactive ultraviolet absorber.

Acrylic monomers usable herein include the following compounds:

methyl acrylate, methyl methacrylate, ethyl acrylate, ethyl methacrylate, propyl acrylate, propyl methacrylate, butyl acrylate, butyl methacrylate, isobutyl acrylate, isobutyl methacrylate, tert-butyl acrylate, tert-butyl methacrylate, isodecyl acrylate, isodecyl methacrylate, lauryl acrylate, lauryl methacrylate, lauryltridecyl acrylate, lauryltridecyl methacrylate, tridecyl acrylate, tridecyl methacrylate, cerylstearyl acrylate, ceryl-stearyl methacrylate, stearyl acrylate, stearyl methacrylate, ethylhexyl acrylate, ethylhexyl methacrylate, octyl acrylate, octyl methacrylate, cyclohexyl acrylate, cyclohexyl methacrylate, benzyl acrylate, benzyl methacrylate, methacrylic acid, hydroxyethyl acrylate, hydroxyethyl methacrylate, hydroxypropyl acrylate, hydroxypropyl methacrylate, dimethylaminoethyl acrylate, dimethylaminoethyl methacrylate, diethylaminoethyl acrylate, diethylaminoethyl methacrylate, tert-butylaminoethyl acrylate, tert-butylaminoethyl methacrylate, glycidyl acrylate, glycidyl methacrylate, tetrahydrofurfuryl acrylate, tetrahydrofurfuryl methacrylate, ethylene diacrylate, ethylene dimethacrylate, diethylene glycol diacrylate, diethylene glycol dimethacrylate, triethylene glycol diacrylate, triethylene glycol dimethacrylate, tetraethylene glycol diacrylate, tetraethylene glycol dimethacrylate, decaethylene glycol diacrylate, decaethylene glycol dimethacrylate, pentadecaethylene glycol diacrylate, pentadecaethylene glycol dimethacrylate, pentacontahectaethylene glycol diacrylate, pentacontahectaethylene glycol dimethacrylate, butylene diacrylate, butylene dimethacrylate, allyl acrylate, allyl methacrylate, trimethylolpropane triacrylate, trimethylolpropane trimethacrylate, hexanediol diacrylate, hexanediol dimethacrylate, tripropylene glycol diacrylate, tripropylene glycol dimethacrylate, pentaerythritol tetraacrylate, pentaerythritol tetramethacrylate, pentaerythritol hexaacrylate, pentaerythritol hexamethacrylate, dipentaerythritol hexaacrylate, dipentaerythritol hexamethacrylate, 1,6-hexanediol diacrylate, 1,6-hexanediol dimethacrylate, neopentylglycol pentaacrylate, neopentylglycol pentamethacrylate, phosphazene hexaacrylate, and phosphazene hexamethacrylate. These acrylic monomers may be used alone or as a mixture of two or more.

The content of the reactive ultraviolet absorber in the random copolymer of the reactive ultraviolet absorber with the acrylic monomer is generally 10 to 90% by weight, preferably 30 to 70% by weight. The molecular weight of the random copolymer is generally about 5,000 to 250,000, preferably about 9,000 to 30,000.

Examples of the random copolymer of the reactive ultraviolet absorber with the acrylic monomer include, but are not limited to, those represented by the general formula (3):

(3)

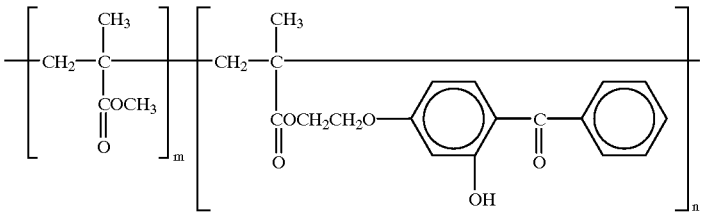

wherein m and n are an integer.

Further, a benzotriazole ultraviolet absorber may be incorporated generally in an amount of 10 to 70% by weight, preferably 30 to 60% by weight, into the thermally transferable protective layer 12 and the protective layer 12*a* from the viewpoint of improving the ultraviolet absorption.

Examples of preferred benzotriazole ultraviolet absorbers include those represented by the following general formula (5):

(5)

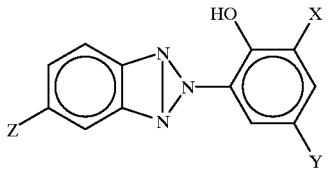

wherein X and Y represent an optionally branched alkyl group or aralkyl group having 4 to 12 carbon atoms and Z represents hydrogen or a chlorine atom.

(3) Adhesive layer

The adhesive layer 12*b* functions to facilitate the transfer of the protective layer 12*a* to an object.

Adhesives usable for the adhesive layer include (meth) acrylate, styrene/(meth)acrylate, vinyl chloride, styrene/vinyl chloride/vinyl acetate copolymer, vinyl chloride/vinyl acetate copolymer, polyester, polyamide and other hot-melt adhesives. The adhesive layer may be formed by a conventional method, such as gravure coating, gravure reverse coating, or roll coating. The thickness of the adhesive layer is preferably about 0.1 to 5 $\mu$m.

(4) Backside layer

The backside layer 13 is provided to prevent heat blocking between a heating device, such as a thermal head, and the substrate sheet 11 and to improve the slip property of the protective layer transfer sheet. Resins usable in the backside layer 13 include naturally occurring and synthetic resins, for example, cellulosic resins, such as ethylcellulose, hydroxycellulose, hydroxypropylcellulose, methylcellulose, cellulose acetate, cellulose acetate butyrate, and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile/styrene copolymer, polyamide resin, polyvinyltoluene resin, coumarone-indene resin, polyester resin, polyurethane resin, silicone-modified or fluorine-modified urethane. They may be used alone or as a mixture of two or more. In order to enhance the heat resistance of the backside layer 13, the backside layer 13 is preferably constituted by a crosslinked resin layer formed by using a resin having a hydroxyl reactive group among the above resins in combination with polyisocyanate or the like as a crosslinking agent.

Further, from the viewpoint of imparting slidability of the protective layer transfer sheet on the thermal head, a solid or liquid release agent or lubricant may be added to the backside layer 13 to provide heat slip properties. Release agents or lubricants usable herein include, for example, various waxes, such as polyethylene wax and paraffin waxes, higher aliphatic alcohols, organopolysiloxanes, anionic surfactants, cationic surfactants, amphoteric surfactants, nonionic surfactants, fluorosurfactants, organic carboxylic acids and derivatives thereof, fluororesins, silicone resins, and fine particles of inorganic compounds, such as talc and silica. The content of the release agent or the lubricant in the backside layer 6 is generally about 5 to 50% by weight, preferably about 10 to 30% by weight.

The thickness of the backside layer 13 is generally about 0.1 to 10 $\mu$m, preferably about 0.5 to 5 $\mu$m.

(5) Release layer

The release layer 14 is provided when, in a combination of the substrate sheet 11 with the protective layer 12, the releasability of the protective layer at the time of the thermal transfer of the protective layer is unsatisfactory. In particular, in the case of a substrate sheet subjected to treatment for rendering the substrate sheet adhesive, when the protective layer is provided directly on the substrate sheet, the transferability of the protective layer from the substrate sheet is deteriorated. In this case, the provision of the release layer is preferred. Materials for the release layer are not particularly limited. For example, the release layer may be formed of a release agent, for example, a wax, such as a silicone wax, a silicone resin, or a fluororesin. Alternatively, the material for the release layer may be properly selected from hydrophilic resins disclosed in Japanese Patent Laid-Open No. 142988/1992 and various curable resins according to properties of the substrate sheet and the protective layer. The release layer may be formed by coating an ink, prepared by dissolving or dispersing the release agent and an optional additive in a suitable solvent, onto the substrate sheet 11 by a conventional method and then drying the coating. The thickness of the release layer is preferably about 0.1 to 5 $\mu$m.

Figure 5:
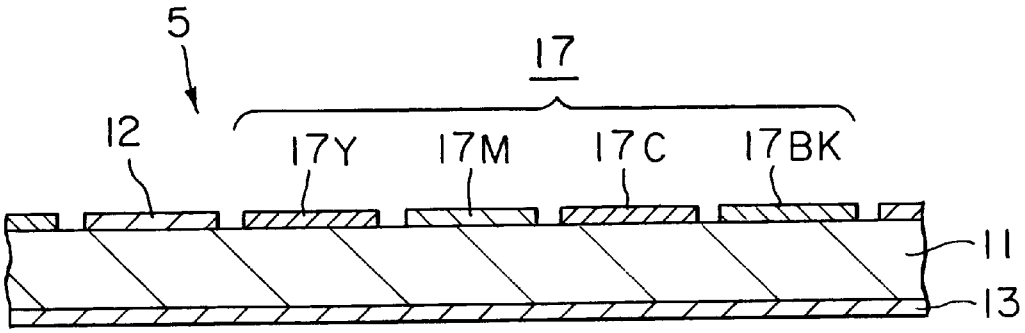
FIG. 5 is a schematic cross-sectional view of a still further embodiment of the present invention.

FIG. 5 is a schematic cross-sectional view showing a further embodiment of the protective layer transfer sheet according to the present invention. In FIG. 5, the protective layer transfer sheet 5 is an integral thermal transfer sheet, used in thermal dye transfer, which serves both as a protective layer transfer sheet and a thermal dye transfer sheet. The protective layer transfer sheet 5 comprises: a substrate sheet 11; a protective layer 12 and a dye layer 17 provided in a face serial manner on one side of the substrate sheet 11; and a backside layer 13 provided on the other side of the substrate sheet 11.

The protective layer 12 may have the single-layer structure or laminate structure as described above. The substrate sheet 11 and the backside layer 13 also may be the same as those described above. Further, as described above, the release layer 14 may be provided between the substrate sheet 11 and the protective layer 12.

The dye layer 17 is constituted by dye layers 17Y, 17M, 17C, and 17BK respectively having hues of yellow, magenta, cyan, and black. The dye layer 17 (17Y, 17M, 17C, and 17BK) comprises at least a dye and a binder resin.

Dyes usable herein include, but are not particularly limited to, dyes commonly used in conventional thermal transfer sheets for thermal dye transfer, such as azo, azomethine, methine, anthraquinone, quinophthalone, and naphthoquinone dyes. Various dyes as described above may be combined to form a dye layer having any desired hue of black or the like.

Binder resins usable for holding the dye in the dye layer 17 include conventional binders, for example, cellulosic resins, such as ethylcellulose, hydroxyethylcellulose, hydroxypropylcellulose, methylcellulose, cellulose acetate, and cellulose acetate butyrate, vinyl resins, such as polyvinyl alcohol, polyvinyl acetate, polyvinyl butyral, polyvinyl acetal, polyvinyl pyrrolidone, and polyacrylamide, and polyesters. Among them, cellulosic, acetal, butyral, and polyester binder resins are preferred from the viewpoint of heat resistance and transferability of dyes.

Further, any conventional release agent may be used in the dye layer 17 from the viewpoint of preventing heat blocking between the binder for the dye layer and a resin in a receptive layer at the time of printing. Specific examples of release agents usable herein include various waxes, such as polyethylene wax and paraffin wax, higher aliphatic alcohols, organopolysiloxanes, various surfactants, various phosphoric esters, fluororesins, and silicone resins.

The dye layer 17 may be formed by coating an ink, prepared by dissolving or dispersing the sublimable dye, the binder resin, and an optional additive in a suitable solvent, onto the substrate sheet by a conventional method and then drying the coating. The thickness of the dye layer 17 is generally about 0.2 to 5 $\mu$m, preferably 0.4 to 2 $\mu$m. The content of the sublimable dye in the dye layer 17 is generally 5 to 90% by weight, preferably 10 to 70% by weight.

In the protective layer transfer sheet 5, the protective layer 12, 17Y, 17M, 17C, and 17BK are provided in that order in a face serial manner. The construction of the protective layer transfer sheet according to embodiment is not limited to this only. The dye layer 17BK for black may be omitted. Further, the dye layer 17 (17Y, 17M, 17C, and 17BK) may partially or entirely have a two-layer structure.

The protective layer transfer sheet according to the present invention is not limited to the above embodiments and may be varied or modified as desired according to applications and the like. In particular, when the protective layer transfer sheet is in the form of a composite type protective layer transfer sheet, the formation of an image by thermal transfer can be carried out simultaneously with the transfer of a protective layer onto a print.

Print

The print of the present invention will be described.

Figure 6:
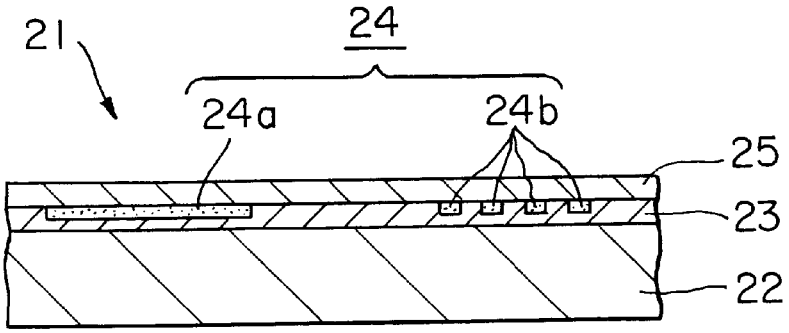
FIG. 6 is a schematic cross-sectional view showing one embodiment of the print according to the present invention.

FIG. 6 is a schematic cross-sectional view showing one embodiment of the print according to the present invention. In FIG. 6, the print 21 comprises: a substrate 22 bearing a dye-receptive layer 23; an image 24 which has been recorded by thermal dye transfer onto the dye-receptive layer 23 provided on the substrate 22; and a protective layer 25 covering the image 24. The image 24 may comprise a full-color image 24*a* of three colors of yellow, magenta, cyan, or four colors of yellow, magenta, cyan, and black, and a monotone image 24*b* of a letter, a symbol or the like.

In the print 21 shown in FIG. 6, the image 24 is entirely covered with the protective layer 25. The protective layer 25 may be formed by transferring the protective layer 12 in the protective layer transfer sheet of the present invention so as to cover the image 24. Therefore, by virtue of the provision of the protective layer 25, the print 21 of the present invention possesses good fastness properties, such as good light fastness, weather fastness, and rubbing fastness.

The following examples further illustrate the present invention but are not intended to limit it.

Preparation of Aromatic Polycarbonate Resins

The following polycarbonate resins (PC-1 to PC-8, PC-1', and PC-1"), were prepared and the glass transition temperature Tg thereof was measured under the following conditions. Further, each polycarbonate resin was added in an amount of 20% by weight to a solvent composed of a 1:1 mixture of methyl ethyl ketone and toluene, and the mixture was shaken for 8 hr at room temperature to evaluate the solubility of the polycarbonate resins. The results are summarized in the following Table 1.

PC-1: A polycarbonate resin which is a homopolymer consisting of structural units represented by the following general formula (1)

PC-2: A polycarbonate resin which is a random copolymer comprising 20% by mole of structural units represented by the following general formula (2) and 80% by mole of structural units represented by the following general formula (1)

PC-3: A polycarbonate resin which is a random copolymer comprising 40% by mole of structural units represented by the following general formula (2) and 60% by mole of structural units represented by the following general formula (1)

PC-4: A polycarbonate resin which is a random copolymer comprising 60% by mole of structural units represented by the following general formula (2) and 40% by mole of structural units represented by the following general formula (1)

PC-5: A polycarbonate resin which is a random copolymer comprising 70% by mole of structural units represented by the following general formula (2) and 30% by mole of structural units represented by the following general formula (1)

PC-6: A polycarbonate resin which is a random copolymer comprising 80% by mole of structural units represented by the following general formula (2) and 20% by mole of structural units represented by the following general formula (1)

PC-7: A polycarbonate resin which is a random copolymer comprising 90% by mole of structural units represented by the following general formula (2) and 10% by mole of structural units represented by the following general formula (1)

PC-8: A polycarbonate resin which is a homopolymer consisting of structural units represented by the following general formula (2)

PC-1': A polycarbonate resin which is a homopolymer consisting of structural units represented by the following general formula (4)

PC-1": A polycarbonate resin which is a random copolymer comprising 50% by mole of structural units represented by the following general formula (2) and 50% by mole of structural units represented by the following general formula (6)

(1)

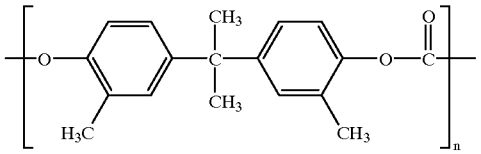

wherein n is an integer;

(2)

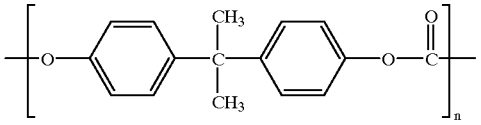

wherein n is an integer;

(4)

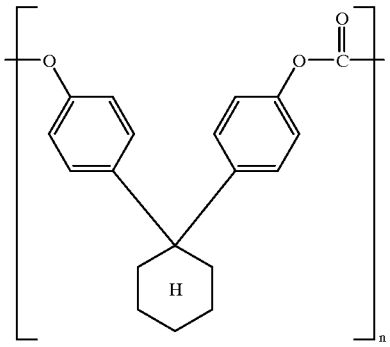

wherein n is an integer; and (6)

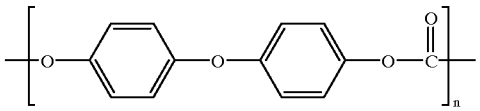

wherein n is an integer.

Glass Transition Temperature

Measured with a differential scanning calorimeter DSC-50 (manufactured by Shimadzu Seisakusho Ltd.) according to JIS K 7121.

A homopolymer, having a glass transition temperature of 67° C., comprising structural units represented by the following general formula (7) (PC-9) was provided as the polycarbonate resin, and the solubility thereof in a nonhalogenated solvent was evaluated in the same manner as described above.

(7)

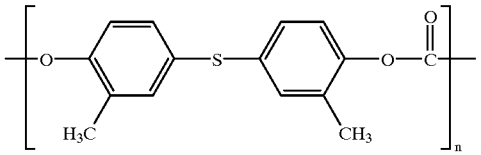

wherein n is an integer.

Further, an acrylic resin having a glass transition temperature of 85° C. (Dianal BR-75, manufactured by Mitsubishi Rayon Co., Ltd.), a vinyl chloride/vinyl acetate copolymer having a glass transition temperature of 65° C. (Denka Vinyl #1000ALK, manufactured by Denki Kagaku Kogyo K. K.), and a polyester resin (PEs-1), having a glass transition temperature of 92° C., synthesized from the following acid moiety and diol moiety by a conventional method were provided, and the solubility thereof in a nonhalogenated solvent was evaluated in the same manner as described above.

Acid moiety: terephthalic acid . . . 50 mol%
isophthalic acid . . . 50 mol%
Diol moiety: diethylene glycol . . . 10 mol%
tetracyclodecane glycol . . . 90 mol%

TABLE 1

| Resin | Glass transition temp. Tg, ° C. | Solubility in nonhalogenated solvent | Viscosity average molecular weight, Mv |
|---|---|---|---|
| PC-1 | 120 | ○ (Transparent solution) | $2.14 \times 10^4$ |
| PC-2 | 127.1 | ○ (Transparent solution) | $2.08 \times 10^4$ |
| PC-3 | 130.7 | ○ (Transparent solution) | $2.24 \times 10^4$ |
| PC-4 | 137 | ○ (Transparent solution) | $2.81 \times 10^4$ |
| PC-5 | 139.8 | ○ (Transparent solution) | $2.80 \times 10^4$ |
| PC-6 | 144.6 | X (Opaque, separated) | $2.76 \times 10^4$ |
| PC-7 | 146.5 | X (Opaque, separated) | $2.82 \times 10^4$ |
| PC-8 | 149 | X (Insoluble) | $2.80 \times 10^4$ |
| PC-1' | 171 | ○ (Transparent solution) | $2.15 \times 10^4$ |
| PC-1" | 135 | ○ (Transparent solution) | $2.80 \times 10^4$ |
| PC-9 | 67 | ○ (Transparent solution) | $1.40 \times 10^4$ |
| Acrylic resin | 85 | ○ (Transparent solution) | — |
| Vinyl chloride/ vinyl acetate copolymer | 65 | ○ (Transparent solution) | — |
| PEs-1 | 92 | ○ (Transparent solution) | — |

From Table 1, it is apparent that PC-1 to PC-5, PC-9, PC-1', PC-1", and acryl resin, vinyl chloride/vinyl acetate copolymer, and polyester resin (PEs-1) are soluble in the nonhalogenated solvent.

Preparation of Coating Liquids for Protective Layer and Coating Liquids for Release Layer The following coating liquids 1 to 13 for a protective layer and the following coating liquids 1 to 2 for a release layer were prepared according to the following formulations.

Coating Liquid 1 for Protective Layer

Polycarbonate resin (PC-1) 20 pts. wt.

Methyl ethyl ketone/toluene=1/1 (weight 80 pts. wt. ratio)

Coating Liquid 2 for Protective Layer

Polycarbonate resin (PC-2) 15 pts. wt.

Acrylic copolymer as ultraviolet absorber 5 pts. wt. (UVA 635L, manufactured by BASF Japan)

Methyl ethyl ketone/toluene=1/1 (weight 80 pts. wt. ratio)

Coating Liquid 3 for Protective Layer

Polycarbonate resin (PC-4) 20 pts. wt.

Benzotriazole ultraviolet absorber 10 pts. wt. (TINUVIN 328, manufactured by CIBA-GEIGY (Japan) Ltd.)

Methyl ethyl ketone/toluene=1/1 (weight 80 pts. wt. ratio)

Coating liquid 4 for Protective Layer

Polycarbonate resin (PC-3) 10 pts. wt.

Polyester resin (PEs-1) 6 pts. wt. Acrylic copolymer as ultraviolet absorber 4 pts. wt. (UVA 635L, manufactured by BASF Japan)

Benzotriazole ultraviolet absorber 10 pts. wt. (TINUVIN 234, manufactured by CIBA-GEIGY (Japan) Ltd.)

Methyl ethyl ketone/toluene=1/1 (weight 80 pts. wt. ratio)

Coating Liquid 5 for Protective Layer

Polycarbonate resin (PC-5) 15 pts. wt.

Polyester resin (PEs-1) 5 pts. wt.

Methyl ethyl ketone/toluene=1/1 (weight 80 pts. wt. ratio)

Coating Liquid 6 for Protective Layer

Polycarbonate resin (PC-1) 20 pts. wt. Methyl ethyl ketone/toluene=1/1 (weight 80 pts. wt. ratio)

Coating Liquid 7 for Protective Layer

Polycarbonate resin (PC-1") 20 pts. wt.

Benzotriazole ultraviolet absorber 10 pts. wt. (TINUVIN 320, manufactured by CIBA-GEIGY (Japan) Ltd.)

Methyl ethyl ketone/toluene=1/1 (weight 80 pts. wt. ratio)

Coating Liquid 8 for Protective Layer

Polycarbonate resin (PC-6) 20 pts. wt.

Trichloromethane 80 pts. wt.

Coating Liquid 9 for Protective Layer

Polycarbonate resin (PC-7) 15 pts. wt.

Acrylic copolymer as ultraviolet absorber 5 pts. wt. (UVA 635L, manufactured by BASF Japan)

Trichloromethane 80 pts. wt.

Coating Liquid 10 for Protective Layer

Polycarbonate resin (PC-8) 20 pts. wt.

Benzotriazole ultraviolet absorber 10 pts. wt. (TINUVIN 328, manufactured by CIBA-GEIGY (Japan) Ltd.)

Trichloromethane 80 pts. wt.

Coating Liquid 11 for Protective Layer

Polycarbonate resin (PC-9) 20 pts. wt.

Methyl ethyl ketone/toluene=1/1 (weight 80 pts. wt. ratio)

Coating Liquid 12 for Protective Layer

Acrylic resin 20 pts. wt. (Dianal BR-75, manufactured by Mitsubishi Rayon Co., Ltd.)

Methyl ethyl ketone/toluene=1/1 (weight 80 pts. wt. ratio)

Coating Liquid 13 for Protective Layer

Vinyl chloride/vinyl acetate copolymer 20 pts. wt. (Denka Vinyl #1000ALK, manufactured by Denki Kagaku Kogyo K. K.)

Benzotriazole ultraviolet absorber 10 pts. wt. (TINUVIN 328, manufactured by CIBA-GEIGY (Japan) Ltd.)

Methyl ethyl ketone/toluene=1/1 (weight 80 pts. wt. ratio)

Coating Liquid 1 for Release Layer

Alkyl vinyl ether/maleic anhydride 10 pts. wt. copolymer derivative (VEMA, manufactured by Daicel Chemical Industries, Ltd.)

Polyvinyl alcohol resin (manufactured by 2 pts. wt. Kuraray Co., Ltd.)

Water/ethanol=2/3 (weight ratio) 100 pts. wt.

Coating Liquid 2 for Release Layer

Ionomer resin (manufactured by Mitsui 10 pts. wt. Chemical Co. Ltd.)

Water/ethanol=2/3 (weight ratio) 100 pts. wt.

Preparation of Thermal Transfer Image Receiving Sheets

The following thermal transfer image receiving sheets (image receiving papers 1 and 2) were prepared.

Image Receiving Paper 1

A 150 $\mu$m-thick synthetic paper (YUPO FPG#150, manufactured by Oji-Yuka Synthetic Paper Co., Ltd.) was provided as a substrate sheet. A coating liquid, for a receptive layer, having the following compositions was coated on one side of the substrate sheet by wire bar coating (coverage 5.0 g/m$^2$ on solid basis), and the coating was dried at 110° C. for 30 sec. Thus, a thermal transfer image receiving sheet (image receiving paper 1) was prepared.

Coating Liquid for Receptive Layer

Vinyl chloride/vinyl acetate copolymer 10 pts. wt. (Denka Vinyl #1000A, manufactured by Denki Kagaku Kogyo K. K.)

Epoxy-modified silicone 1 pt. wt. (X-22-3000T, manufactured by The Shin-Etsu Chemical Co., Ltd)

Methyl ethyl ketone/toluene=1/1 (weight 40 pts. wt. ratio)

Image receiving paper 2

A thermal transfer image receiving sheet (image receiving paper 2) was prepared in the same manner as described above in connection with the preparation of image receiving paper 1, except that the coating liquid, for a receptive layer, having the following composition was used instead of the coating liquid for a receptive layer in image receiving paper 1.

Coating Liquid for Receptive Layer

Polycarbonate resin (PC-3) 7 pts. wt.

Polycaprolactone 1 pt. wt. (PLACCEL H7, manufactured by Daicel Chemical Industries, Ltd.)

Methyl/phenylsiloxane 1.5 pts. wt.

Methyl ethyl ketone/toluene=1/1 (weight 40 pts. wt. ratio)

Preparation of Protective Layer Transfer Sheets

Next, the following protective layer transfer sheets (Examples 1 to 7 and Comparative Examples 1 to 6) were prepared.

EXAMPLE 1

An ink, for a backside layer, having the following composition was coated by gravure coating on one side of a 6 μm-thick polyethylene terephthalate film (Lumirror, manufactured by Toray Industries, Inc.) as a substrate sheet. The coating was then dried and heat-cured to form a backside layer (thickness 1 μm).

The coating liquid 1 for a Protective Layerwas coated on the substrate sheet in its side remote from the backside layer by gravure coating at a coverage on a dry basis of 2 g/m$^2$, and the coating was then dried (110° C./60 sec) to prepare a protective layer transfer sheet of the present invention.

Ink for backside layer

Polyvinyl butyral resin (S-lec BX-1, 3.6 pts. wt. manufactured by Sekisui Chemical Co., Ltd.)

Polyisocyanate (Burnock D750-45, 19.2 pts. wt. manufactured by Dainippon Ink and Chemicals, Inc.)

Phosphoric ester surfactant (Plysurf 2.9 pts. wt. A208S, manufactured by Dai-Ichi Kogyo Seiyaku Co., Ltd.)

Phosphoric ester surfactant (Phosphanol 0.3 pt. wt. RD720, manufactured by Toho Chemical Industry Co., Ltd.)

Talc (Y/X=0.03, manufactured by Nippon 0.2 pt. wt. Talc Co., Ltd.)

Methyl ethyl ketone 33 pts. wt.

Toluene 33 pts. wt.

EXAMPLE 2

A backside layer (thickness 1 μm) was formed on a 6 μm-thick polyethylene terephthalate film (6FK203E, manufactured by Diafoil Hoechst Co., Ltd.) as a substrate sheet in its nonadhesive side in the same manner as in Example 1.

The coating liquid 1 for a release layer was then coated on the substrate sheet in its adhesive side remote from the backside layer by gravure coating at a coverage on a dry basis of 0.5 g/m$^2$, and the coating was dried (110° C./60 sec). Thereafter, the coating liquid 2 for a protective layer was coated at a coverage of 2 g/m$^2$, and the coating was dried (110° C./60 sec) to prepare a protective layer transfer sheet of the present invention.

EXAMPLE 3

A protective layer transfer sheet for a protective layer of the present invention was prepared in the same manner as in Example 1, except that the coating liquid 3 for a protective layer was used instead of the coating liquid 1 for a protective layer.

EXAMPLE 4

A protective layer transfer sheet for a protective layer of the present invention was prepared in the same manner as in Example 2, except that the coating liquid 2 for a release layer was used instead of the coating liquid 1 for a release layer and the coating liquid 4 for a protective layer was used instead of the coating liquid 2 for a protective layer.

EXAMPLE 5

A protective layer transfer sheet for a protective layer of the present invention was prepared in the same manner as in Example 1, except that the coating liquid 5 for a protective layer was used instead of the coating liquid 1 for a protective layer.

EXAMPLE 6

A protective layer transfer sheet for a protective layer of the present invention was prepared in the same manner as in Example 2, except that the coating liquid 2 for a release layer was used instead of the coating liquid 1 for a release layer and the coating liquid 6 for a protective layer was used instead of the coating liquid 2 for a protective layer.

EXAMPLE 7

A protective layer transfer sheet for a protective layer of the present invention was prepared in the same manner as in Example 1, except that the coating liquid 7 for a protective layer was used instead of the coating liquid 1 for a protective layer.

Comparative Example 1

A comparative protective layer transfer sheet was prepared in the same manner as in Example 1, except that the coating liquid 8 for a protective layer was used instead of the coating liquid 1 for a protective layer.

Comparative Example 2

A comparative protective layer transfer sheet for a protective layer was prepared in the same manner as in Example 2, except that the coating liquid 9 for a protective layer was used instead of the coating liquid 2 for a protective layer.

Comparative Example 3

A comparative protective layer transfer sheet for a protective layer was prepared in the same manner as in Example 1, except that the coating liquid 10 for a protective layer was used instead of the coating liquid 1 for a protective layer.

Comparative Example 4

A comparative protective layer transfer sheet for a protective layer was prepared in the same manner as in Example 2, except that the coating liquid 2 for a release layer was used instead of the coating liquid 1 for a release layer and the coating liquid 11 for a protective layer was used instead of the coating liquid 2 for a protective layer.

Comparative Example 5

A comparative protective layer transfer sheet for a protective layer was prepared in the same manner as in Example 1, except that the coating liquid 12 for a protective layer was used instead of the coating liquid 1 for a protective layer.

Comparative Example 6

A comparative protective layer transfer sheet for a protective layer was prepared in the same manner as in Example 2, except that the coating liquid 13 for a protective layer was used instead of the coating liquid 2 for a protective layer.

Evaluation of Protective Layer Transfer Sheet

The protective layer transfer sheets (Examples 1 to 7 and Comparative Examples 1 to 6) thus prepared were evaluated for the kick back fastness as follows. The results are summarized in the following Table 2.

Evaluation of Kick Back Fastness

Preparation of Samples (1) A sheet of a thermal dye transfer film PK700L for a video printer CP-700 manufactured by Mitsubishi Electric Corporation was put on the top of another sheet of the thermal dye transfer film PK700L so that the cyan dye side of one of the sheets faced the backside of the other sheet. The laminate was stored at 50° C. for 100 hr under a load of 2 kgf/cm$^2$ to kick off the cyan dye against the backside of the thermal dye transfer film PK700L.

(2) The backside against which the cyan dye had been kicked off was put on the top of the protective layer transfer sheets prepared in the examples and the comparative examples, and the laminates were stored at 60° C. for 4 hr under a load of 2 kgf/cm$^2$ to back the cyan dye against the surface of the protective layer.

Quantitative Determination

The density (O.D. value) before and after the backing of the cyan dye was measured with a reflection densitometer Macbeth RD 918 manufactured by Sakata INX Corp., and a difference in density (ΔO.D.) was determined by the following equation:

ΔO.D.=(O.D. value after backing)—(O.D. value before backing) The kick back fastness was evaluated according to the following criteria.

Evaluation Criteria

◎:ΔO.D.≦0.03

○:0.03<ΔO.D.≦0.06

Δ:0.06<ΔO.D.≦0.09

×:0.09<ΔO.D.

A halftone image was formed by thermal transfer recording according to the following method.

Thermal Transfer Recording

A thermal dye transfer film PK700L for a video printer CP-700 manufactured by Mitsubishi Electric Corporation was provided as a thermal dye transfer film, and the image receiving paper 1 or the image receiving paper 2 was provided as an image receiving sheet. The thermal transfer film and the image receiving sheet were put on top of each other so that the dye layer faced the dye receiving surface. Thermal transfer recording was carried out by applying a thermal head to the backside of the thermal transfer film under the following conditions to transfer dyes in the order of Y (yellow), M (magenta), and C (cyan) onto the image receiving sheet. Thus, a halftone image of gray was formed.

Printing Conditions

Thermal head: KGT-217-12MPL20 (manufactured by Kyocera Corp.)

Average resistance of heating element: 3195 Ω

Printing density in scanning direction: 300 dpi

Printing density in feed direction: 300 dpi

Applied electric power: 0.12 w/dot

One line period: 5 msec

Printing initiation temp.: 40° C.

Gradation control: A test printer of a multi-pulse system was provided which had such a pulse length that one line period was divided into 256 equal parts and wherein the number of divided pulses could be varied from 0 to 255 during one line period. The duty ratio of each divided pulse was fixed at 60%, and, according to the gradation, the number of pulses per line period was increased stepwise in 17 increments from 0 to 255, that is, was 0 for step 0, 17 for step 1, and 34 for step 2. Thus, 16 gradations from step 0 to step 15 were controlled.

Next, a protective layer was transferred onto the gradation image thus formed.

Transfer of Protective Layer

For the prints formed by the above thermal transfer recording, the protective layer transfer sheets prepared in the examples and the comparative examples were put on the top of the prints so that the surface of the protective layer faced the image received surface, followed by transfer of the protective layer over the whole surface of the prints by means of a thermal head under the following printing conditions.

Printing Conditions

Thermal head: KGT-217-12MPL20 (manufactured by Kyocera Corp.)

Average resistance of heating element: 3195Ω

Printing density in scanning direction: 300 dpi

Printing density in feed direction: 300 dpi

Applied electric power: 0.12 w/dot

One line period: 5 msec

Printing initiation temp.: 40° C.

Applied pulse: A test printer of a multi-pulse system was provided which had such a pulse length that one line period was divided into 256 equal parts and wherein the number of divided pulses could be varied from 0 to 255 during one line period. Solid printing was carried out with the duty ratio of each divided pulse being fixed at 60% and the number of pulses per line period being fixed to 210, followed by transfer of the protective layer over the whole surface of the prints.

The prints with the protective layer provided thereon were evaluated for light fastness by the following method. The results are summarized in the following Table 2.

Light Fastness Test

For the prints with the protective layer provided thereon, a light fastness test was carried out using a xenon Fade-O-Meter under the following conditions.

Irradiation tester: Ci 35 manufactured by Atlas

Light source: xenon lamp

Filter: inside=IR filter, outside=soda lime glass

Black panel temp.: 45° C.

Irradiation intensity: 1.2 W/m$^2$ as measured at 420 nm

Irradiation energy: 400 kJ/m$^2$ in terms of integrated value at 420 nm

Subsequently, the optional reflection density of the Cy component in the gray image was measured with an optical densitometer (Macbeth RD-918, manufactured by Macbeth) through a red filter. In this case, for the step with the optical reflection density before the irradiation being around 1.0, a difference in optical density between before and after the irradiation was determined, and the retention of the optical density was calculated by the following equation:

Retention (%)=(optional reflection density after irradiation/optical reflection density before irradiation)×100

The light fastness of the prints was evaluated according to the following criteria.

Evaluation Criteria

◎: retention of not less than 80%

○: retention of 70 to less than 80%

Δ: retention of 60 to less than 70%

×: retention of less than 60%

TABLE 2

| Protective layer transfer sheet | Image receiving sheet | Kick back fastness | Light fastness | Solvent for coating liquid for protective layer* | Overall evaluation |
|---|---|---|---|---|---|
| Example 1 | Image receiving sheet 1 | ◎ | ○ | ○ | ○ |
| Example 2 | Image receiving sheet 2 | ◎ | ◎ | ○ | ○ |
| Example 3 | Image receiving sheet 1 | ○ | ◎ | ○ | ○ |
| Example 4 | Image receiving sheet 2 | ○ | ◎ | ○ | ○ |
| Example 5 | Image receiving sheet 1 | ◎ | ○ | ○ | ○ |
| Example 6 | Image receiving sheet 2 | ◎ | ○ | ○ | ○ |
| Example 7 | Image receiving sheet 1 | ○ | ◎ | ○ | ○ |
| Comparative Example 1 | Image receiving sheet 1 | ◎ | ○ | X | X |
| Comparative Example 2 | Image receiving sheet 2 | ◎ | ○ | X | X |
| Comparative Example 3 | Image receiving sheet 1 | ○ | ◎ | X | X |
| Comparative Example 4 | Image receiving sheet 2 | X | ○ | ○ | X |
| Comparative Example 5 | Image receiving sheet 1 | Δ | X | ○ | X |
| Comparative Example 6 | Image receiving sheet 2 | X | X | ○ | X |

Note) *: ○ represents that a nonhalogenated solvent is usable, and X represents that use of a halogenated solvent is necessary.

As is apparent from Table 2, all the protective layer transfer sheets of the present invention (Examples 1 to 7) possessed excellent kick back fastness and light fastness.

By contrast, the protective layer transfer sheets (Comparative Examples 1 to 3) also possessed excellent kick back fastness and light fastness. In these comparative protective layer transfer sheets, however, a halogenated solvent should be used in the preparation thereof. This renders the comparative protective layer transfer sheets unsuitable for practical use from the viewpoint of work environment.

The protective layer transfer sheets (Comparative Examples 4 to 6) were poor in at least one of the kick back fastness and the light fastness and hence were unsuitable for practical use.

What is claimed is:

1. A protective layer transfer sheet comprising: a substrate sheet; and a thermally transferable protective layer provided on at least a part of one side of the substrate sheet, the protective layer comprising at least an aromatic polycarbonate resin which is soluble in a nonhalogenated solvent and has a glass transition temperature Tg of 80° C. or above.

2. The protective layer transfer sheet according to claim 1, wherein the aromatic polycarbonate resin comprises either a random copolymer of structural units represented by the following general formula (1) with not more than 70% by mole of structural units represented by the following general formula (2), or a homopolymer consisting of structural units represented by the following general formula (1):

(1)

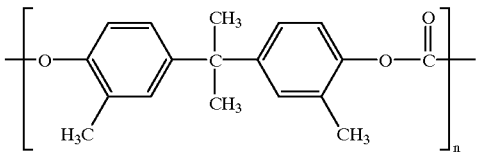

wherein n is an integer; and (2)

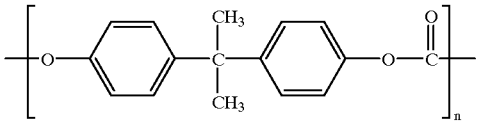

wherein n is an integer.

3. The protective layer transfer sheet according to claim 1, wherein the protective layer further comprises at least one member selected from the group consisting of an acrylic resin, a styrene resin, a polyester resin, and a polyvinyl acetal resin, each of the resins having a glass transition temperature Tg of 80° C. or above.

4. The protective layer transfer sheet according to claim 3, wherein the polyester resin is an alicyclic polyester resin comprising an alicyclic compound comprised of at least one diol moiety and at least one acid moiety.

5. The protective layer transfer sheet according to claim 4, wherein the alicyclic compound is tetracyclodecane glycol.

6. The protective layer transfer sheet according to claim 1, wherein the protective layer further comprises a random copolymer of a reactive ultraviolet absorber with an acrylic monomer, the random copolymer having a glass transition temperature Tg of 60° C. or above and represented by the following general formula (3):

(3)

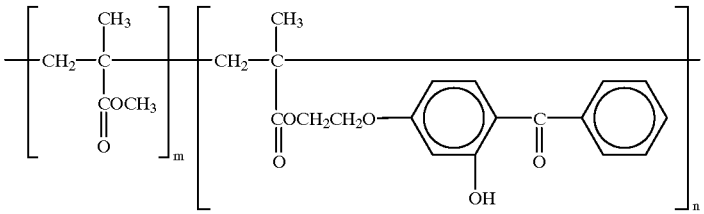

wherein m and n are an integer.

7. The protective layer transfer sheet according to claim 1, wherein the protective layer further comprises a benzotriazole ultraviolet absorber.

8. The protective layer transfer sheet according to claim 7, wherein the benzotriazole ultraviolet absorber is represented by the following general formula (5):

(5)

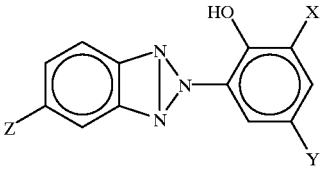

wherein X and Y represent an optionally branched alkyl group or aralkyl group having 4 to 12 carbon atoms and Z represents hydrogen or a chlorine atom.

9. A print comprising a substrate having, on at least one side thereof, at least a dye image and a protective layer covering at least a part of the image, the protective layer having been formed by transfer from the protective layer transfer sheet according to claim 1.

* * * * *